US008453790B1

(12) United States Patent
Oliver et al.

(10) Patent No.: US 8,453,790 B1
(45) Date of Patent: Jun. 4, 2013

(54) FAN COIL CEILING UNIT WITH CLOSELY COUPLED SILENCERS

(75) Inventors: Patrick Oliver, Winnipeg (CA); Alf Dyck, Winnipeg (CA); Bogna Gryc, Winnipeg (CA)

(73) Assignee: E.H. Price Ltd., Winnipeg, Manitoba (CA)

( * ) Notice: Subject to any disclaimer, the term of this patent is extended or adjusted under 35 U.S.C. 154(b) by 0 days.

(21) Appl. No.: 13/354,632

(22) Filed: Jan. 20, 2012

Related U.S. Application Data

(60) Provisional application No. 61/469,368, filed on Mar. 30, 2011.

(51) Int. Cl.
*E04F 17/04* (2006.01)

(52) U.S. Cl.
USPC ..... 181/224; 181/225

(58) Field of Classification Search
USPC ..... 181/224, 225; 454/237, 241, 243, 454/248, 270, 292, 346, 354, 906
See application file for complete search history.

(56) References Cited

U.S. PATENT DOCUMENTS

| | | | | |
|---|---|---|---|---|
| 3,748,997 | A * | 7/1973 | Dean et al. | 454/234 |
| 4,843,839 | A * | 7/1989 | Davis | 62/326 |
| 5,595,068 | A * | 1/1997 | Amr | 62/418 |
| 6,342,005 | B1 * | 1/2002 | Daniels et al. | 454/338 |
| 7,328,586 | B2 * | 2/2008 | Gau et al. | 62/158 |

* cited by examiner

*Primary Examiner* — Jeremy Luks
(74) *Attorney, Agent, or Firm* — Smith Gambrell & Russell LLP

(57) ABSTRACT

A low-profile, compact fan coil ceiling unit with closely coupled silencers includes a heating and cooling section, a closely coupled inlet silencer, and a closely coupled outlet silencer. The inlet silencer has a rectangular housing with a downwardly facing entry opening and a side facing exit opening attached to the inlet end opening of the heating and cooling section. The outlet silencer has a rectangular housing with a downwardly facing exit opening and a side facing entry opening attached to the outlet end opening of the heating and cooling section. Baffles to control the flow of air and reduce noise in the inlet silencer and the outlet silencer are provided.

4 Claims, 3 Drawing Sheets

FAN COIL CEILING UNIT WITH CLOSELY COUPLED SILENCERS

CROSS REFERENCE TO RELATED PATENT APPLICATIONS

This patent application claims priority from U.S. Provisional Patent Application No. 61/469,368, filed Mar. 30, 2011, which is hereby incorporated by reference.

FIELD OF THE INVENTION

This invention relates to an HVAC ceiling unit for heating and cooling an occupied space, and more particularly, to a fan coil ceiling unit having a closely coupled inlet silencer and a closely coupled outlet silencer.

BACKGROUND OF THE INVENTION

In retrofitting facilities with heating and air-conditioning systems, the installation of standard air ducts may be expensive and in some cases impractical. In order to avoid the installation of standard air ducts, fan coil units offer a solution. Particularly, such fan coil units have heating and cooling coils through which heated or chilled liquid is circulated. A fan draws air from the occupied space through an intake opening, moves the air across the heating and cooling coils, and discharges the air back into the occupied space through a discharge opening. The advantage of such a fan coil unit is that the piping for the heated or chilled liquid is substantially smaller than air ducts and can be more easily installed as part of a heating and air-conditioning retrofit. Because the fan coil unit has a fan for circulating the air through the fan coil unit, such fan coil units often produce noise levels within the occupied space that are unacceptably high.

Conventional silencers are typically at least 3 feet in length, usually longer. In such conventional silencers, baffles are arranged based on uniform flow in and out of the silencer. Such conventional silencers are operated with long lengths of straight duct before and after the silencer. Such space is not available for a ceiling mounted fan coil.

Further, conventional fan coil installations typically have connecting ductwork between an inlet silencer and the intake grille and connecting ductwork between an outlet silencer and the discharge diffuser. Such connecting ductwork is required for traditional straight flow silencers, but such connecting ductwork takes up additional space.

SUMMARY OF THE INVENTION

Consequently, there is a need for a fan coil unit that can be mounted above a standard drop ceiling of an occupied space and that is relatively quiet and compact. The fan coil unit of the present invention is a low-profile, compact fan coil unit with closely coupled silencers at its intake opening and its discharge opening. The fan coil unit of the present invention is compact, measuring 24 inches (610 mm)×88.5 inches (2248 mm), and therefore, can be mounted over just four ceiling tiles in a standard drop ceiling configuration. Particularly, the fan coil of the present invention does not require connecting ductwork takeoffs for the intake grille and the discharge diffuser, thereby reducing the overall length of the fan coil.

The fan coil unit of the present invention includes a heating and cooling section, an inlet silencer, and an outlet silencer. The heating and cooling section includes a reheat hydronic coil, a chilled water cooling coil, and a fan mounted upstream from the heating and cooling coils. A drain pan is positioned below the cooling coil and collects condensate dripping from the cooling coil. The fan draws air from the occupied space through an intake opening, moves the air over the heating and cooling coils, and discharges the air through a discharge opening back into the occupied space. The intake opening includes an inlet grille with a filter. The discharge opening of the fan coil unit includes a discharge diffuser.

The inlet silencer is closely coupled to the heating and cooling section of the fan coil unit between the intake opening and the heating and cooling section of the fan coil unit. An outlet silencer is closely coupled to the heating and cooling section of the fan coil unit between the discharge opening and the heating and cooling section of the fan coil unit.

The inlet silencer comprises a rectangular metal housing with a downward facing horizontal entry opening and a side facing vertical exit opening. Because the entry opening is in the bottom wall of the inlet silencer, there is no need for connecting ductwork between the inlet silencer and the inlet grille. Air is drawn into the entry opening through the grille and filter, turns 90° within the inlet silencer, and leaves the inlet silencer through its exit opening and into the heating and cooling section of the fan coil unit. The inlet silencer includes an upper angled baffle and a lower block baffle. The upper angled baffle is positioned at an angle to the flow of the air into the inlet silencer thereby redirecting the air flow from a vertical direction to a horizontal direction. The upper angled baffle creates a triangular space between the right angle housing and the angled baffle itself. The triangular space is filled with sound absorbing insulation. The block baffle is positioned on the lower side of the housing adjacent the entry opening of the inlet silencer thereby forcing the air upward before turning 90° toward the exit opening of the inlet silencer. The block baffle is filled with sound absorbing insulation and has a rounded edge adjacent the entry opening of the inlet silencer to smooth the transition of the air flow from a vertical direction to a horizontal direction.

The outlet silencer comprises a rectangular metal housing with a side facing vertical entry opening and a downward facing horizontal exit opening. Because the exit opening is in the bottom wall of the outlet silencer, there is no need for a duct connection between the outlet silencer and the discharge diffuser. Air moves into the entry opening from the heating and cooling section, turns 90° within the outlet silencer, and leaves the outlet silencer through its exit opening, through the diffuser, and into the occupied space. A rounded upper baffle, a rounded lower baffle, and side baffles create a tunnel having a cross-sectional area at the entry opening that is smaller than its cross-sectional area at the exit opening. The space between the metal housing and the rounded upper baffle, a rounded lower baffle, and the side baffles is filled with sound absorbing insulation.

As used herein, the term "closely coupled" means that the inlet and outlet silencers are directly connected to the heating and cooling section of the fan coil ceiling unit without any duct between the heating and cooling section and the inlet and outlet silencers.

Because of the engineered internal baffle arrangement and geometry of the closely coupled inlet silencer and the closely coupled outlet silencer, the fan coil unit of the present invention operates very quietly at a noise criteria (NC) rating of 35 up to 250 cubic feet per minute (cfm) and at an NC rating of 40 up to 400 cfm.

Further objects, features and advantages will become apparent upon consideration of the following detailed description of the invention when taken in conjunction with the drawings and the appended claims.

DETAILED DESCRIPTION OF THE PREFERRED EMBODIMENT

Figure 1:
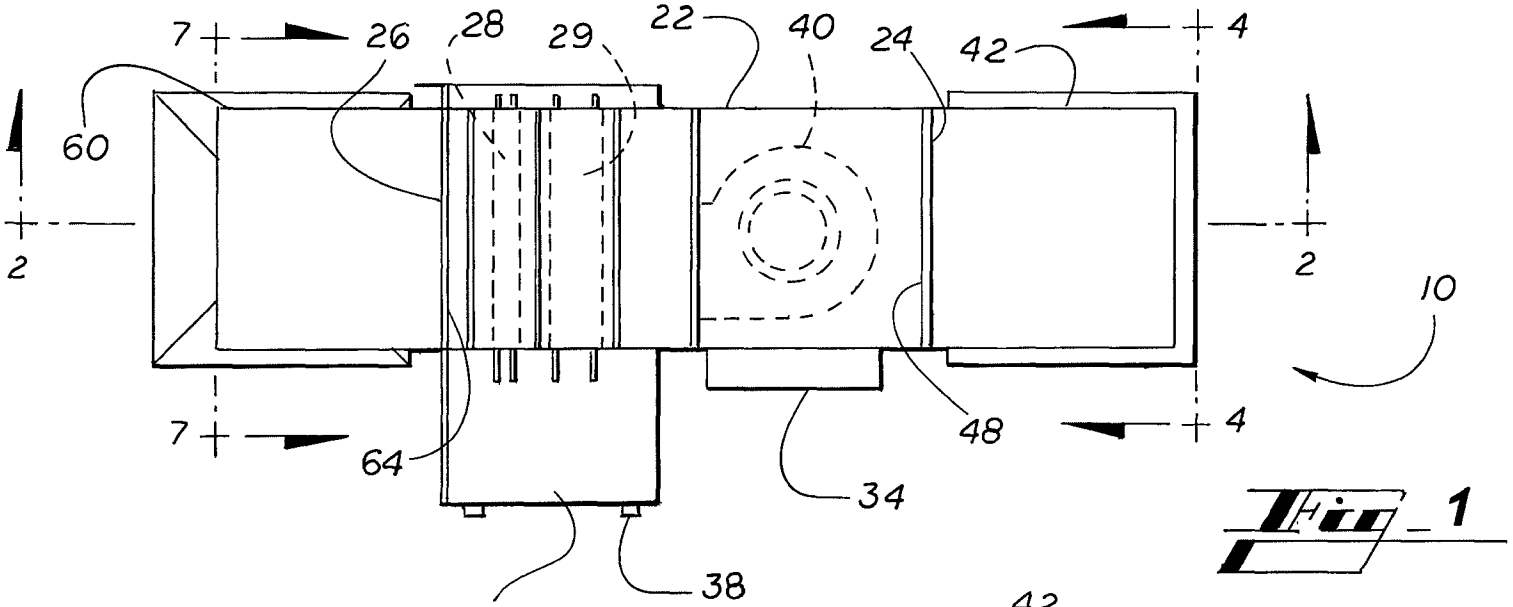
FIG. 1 is a top plan view of a fan coil ceiling unit with closely coupled inlet and outlet silencers in accordance with the present invention.
Figure 2:
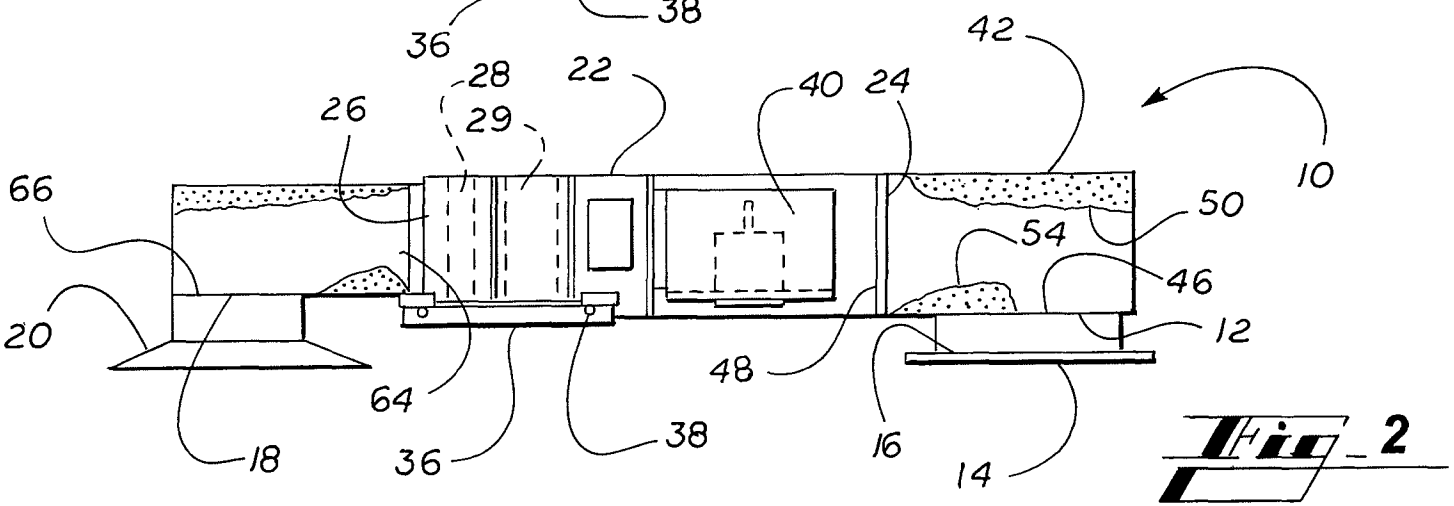
FIG. 2 is a side section view of the fan coil ceiling unit with closely coupled inlet and outlet silencers in accordance with the present invention as seen along line 2-2 of FIG. 1.

Turning to FIGS. 1 and 2, a fan coil ceiling unit 10 of the present invention is a low-profile, compact fan coil ceiling unit used for heating and cooling an occupied space with a conventional drop ceiling. The fan coil ceiling unit 10 is configured to be mounted above the drop ceiling of the occupied space. The fan coil ceiling unit 10 comprises a heating and cooling section 22, a closely coupled inlet silencer 42, and a closely coupled outlet silencer 60. The fan coil unit 10 of the present invention is compact, measuring 24" (610 mm) wide×88.5" (2248 mm) long×14" (373 mm) high, and therefore, can be mounted over just four ceiling tiles in a standard drop ceiling.

The heating and cooling section 22 has an inlet end opening 24 and an outlet end opening 26. The heating and cooling section 22 comprises a reheat hydronic coil 28, a chilled water cooling coil 29, and a fan 40. The fan 40 is mounted upstream from the heating coil 28 and the cooling coil 29. A drain pan 36 with a drain 38 is mounted below the cooling coil and collects condensate dripping from the cooling coil 29. The drain pan 36 is sloped and thereby directs the condensate through the drain 38 to a remote location. A control module 34 controls the flow of liquid through the heating coil 28 and through the cooling coil 29 and controls the operation of the fan 40 in response to control signals from a thermostat or a central control unit. The fan 40 draws air from the occupied space through an intake opening 12, moves the air over the heating coil 28 and the cooling coil 29, and discharges the air through a discharge opening 18 back into the occupied space. The intake opening 12 includes an inlet grille 14 with a filter 16. The discharge opening 18 of the fan coil unit 10 includes a diffuser 20. The fan coil ceiling unit 10 discharges air in a non-uniform flow.

The inlet silencer 42 is closely coupled to the heating and cooling section 22 of the fan coil unit 10 between the intake opening 12 and the inlet end opening 24 of the heating and cooling section 22 of the fan coil unit 10. The outlet silencer 60 is closely coupled to the heating and cooling section 22 of the fan coil unit 10 between the discharge opening 18 and the outlet end opening 26 of the heating and cooling section 22 of the fan coil unit 10.

Figure 5:
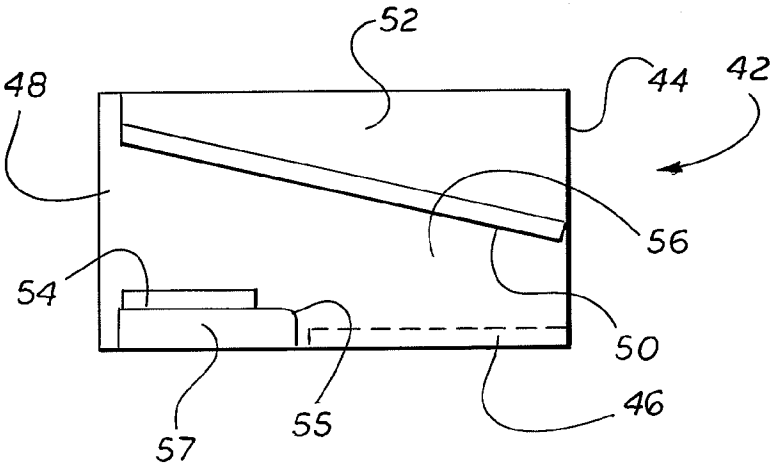
FIG. 5 is a side section view of the inlet silencer for the fan coil ceiling unit in accordance with the present invention as seen along line 5-5 of FIG. 4.
Figure 3:
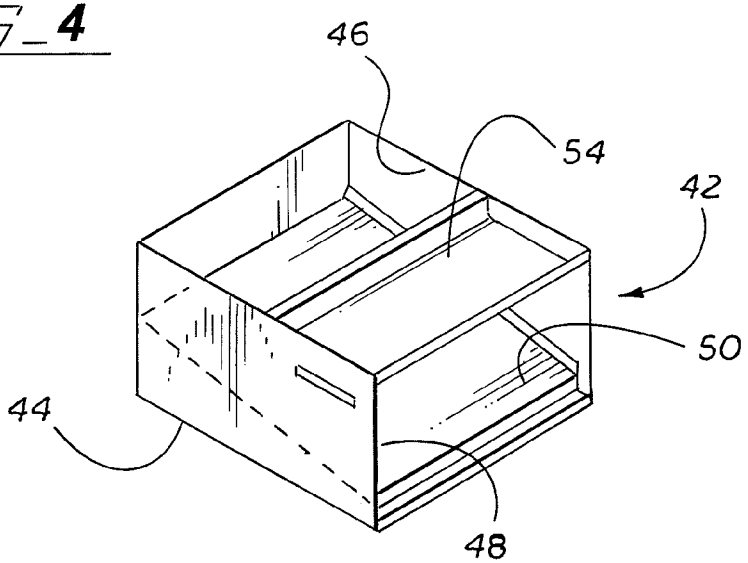
FIG. 3 is a perspective view of an inlet silencer (turned upside down) for the fan coil ceiling unit in accordance with the present invention.
Figure 4:
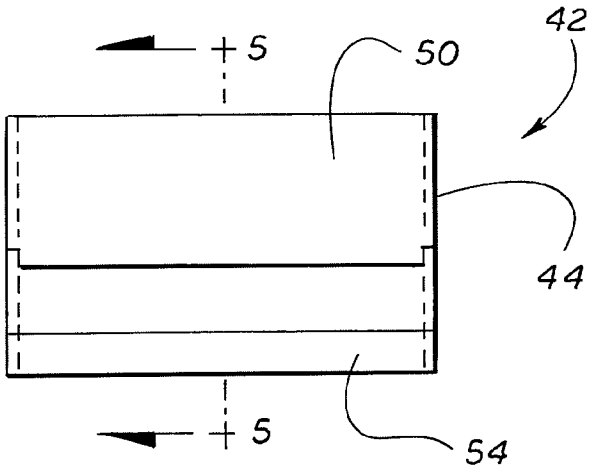
FIG. 4 is an end elevation view of the inlet silencer for the fan coil ceiling unit in accordance with the present invention as seen along line 4-4 of FIG. 1.

Turning to FIGS. 3, 4, and 5, the inlet silencer 42 comprises a rectangular metal housing 44 with a downward facing horizontal entry opening 46 and a side facing vertical exit opening 48. (Note that FIG. 3 shows the inlet silencer 42 turned upside down.) The overall length of the inlet silencer 42 is less than 24 inches (610 mm). The side facing vertical exit opening 48 is connected to the inlet end opening 24 of the heating and cooling section 22. Consequently, air is drawn by the fan 40 into the entry opening 46 through the grille 14 and filter 16, turns 90°, and leaves the inlet silencer 42 through its exit opening 48 and into the heating and cooling section 22 of the fan coil unit 10.

The inlet silencer 42 includes an upper angled baffle 50 and a lower block baffle 54, which together define an inlet tunnel 56 (FIG. 5) between the entry opening 46 and the exit opening 48. The upper angled baffle 50 is positioned at an angle to the flow of the air into the entry opening 46 of the inlet silencer 42, thereby redirecting the air flow from a vertical direction to a horizontal direction. The upper angled baffle 50 creates a triangular space 52 between the right angle housing 44 and the angled baffle 50. The triangular space 52 is filled with sound absorbing insulation. The lower block baffle 54 is positioned on the lower side of the housing 44 adjacent the entry opening 46 of the inlet silencer 42, thereby forcing the air upward before turning 90° toward the exit opening 48 of the inlet silencer 42. The block baffle 54 has an internal block space 57 that is filled with sound absorbing insulation and has a rounded edge 55 that is adjacent the entry opening 46 of the inlet silencer 42. The rounded edge 55 smoothes the transition of the air flow from a vertical direction to a horizontal direction.

Figure 7:
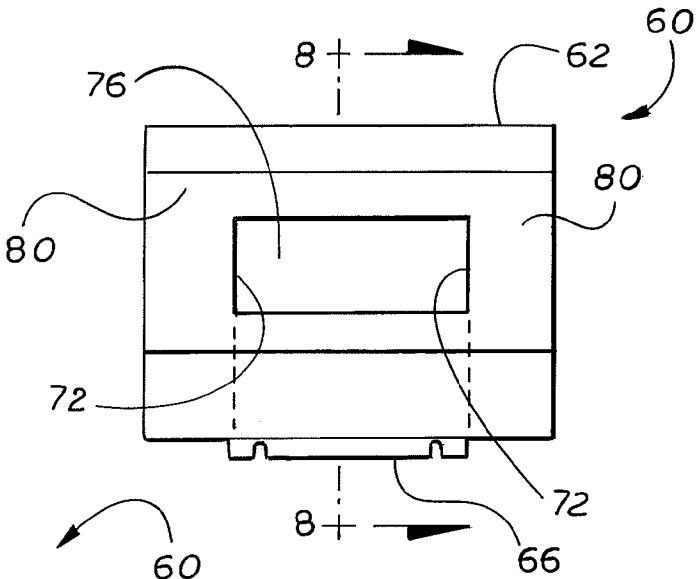
FIG. 7 is an end elevation view of the outlet silencer for the fan coil ceiling unit in accordance with the present invention as seen along line 7-7 of FIG. 1.
Figure 6:
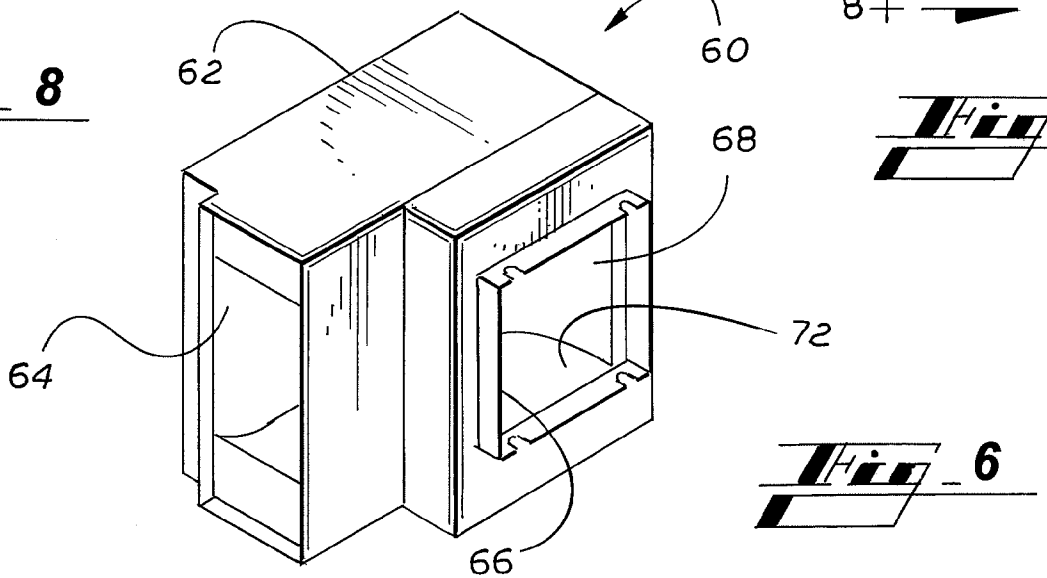
FIG. 6 is a perspective view of an outlet silencer (turned on its side) for the fan coil ceiling unit in accordance with the present invention.
Figure 8:
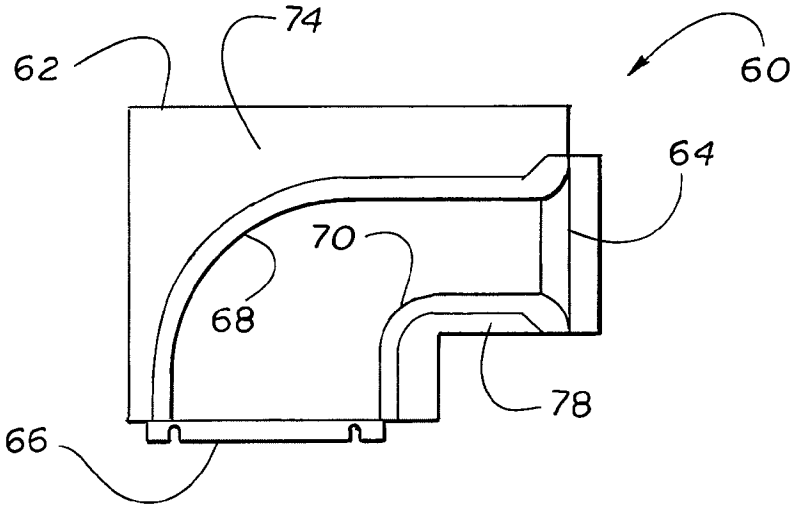
FIG. 8 is a side section view of the outlet silencer for the fan coil ceiling unit in accordance with the present invention as seen along line 8-8 of FIG. 7.

Turning to FIGS. 6, 7, and 8, the outlet silencer 60 comprises a rectangular metal housing 62 with a side facing vertical entry opening 64 and a downward facing horizontal exit opening 66. (Note that FIG. 6 shows the outlet silencer 60 turned on its side.) The overall length of the outlet silencer 60 is less than 24 inches (610 mm). The side facing vertical entry opening 64 is connected to the outlet end opening 26 of the heating and cooling section 22. Consequently, air moves into the entry opening 64 from the heating and cooling section 22, turns 90°, and leaves the outlet silencer 60 through its exit opening 66, through the diffuser 20, and into the occupied space. A rounded upper baffle 68, a rounded lower baffle 70, and side baffles 72 create a tunnel 76 (FIGS. 7 and 8) having a cross-sectional area at the entry opening 64 that is smaller than its cross-sectional area at the exit opening 66. An upper fill space 74 between the metal housing 62 and the rounded upper baffle 68 is filled with sound absorbing material, a lower fill space 78 between the metal housing 62 and the rounded lower baffle 70 is filled with sound absorbing material, and side fill spaces between the metal housing 62 and the side baffles 72 are filled with sound absorbing insulation.

Despite the fact that the inlet silencer and the outlet silencer are less than 24 inches and despite the fact that the silencers have far from ideal inlet/discharge conditions, the silencers perform sufficiently to meet design goals and better than expected with respect to traditional designs. As previously stated, the fan coil ceiling unit 10 of the present invention operates very quietly at a noise criteria (NC) rating of 35 up to 250 cubic feet per minute (cfm) and at an NC rating of 40 up to 400 cfm.

While this invention has been described with reference to preferred embodiments thereof, it is to be understood that variations and modifications can be affected within the spirit and scope of the invention as described herein and as described in the appended claims.

We claim:

1. A fan coil ceiling unit for drawing air from an occupied space, conditioning the air, and discharging the conditioned air back into the occupied space, the fan coil ceiling unit comprising:

a. a heating and cooling section having a inlet end with an inlet end opening and a outlet end with an outlet end opening;

b. an inlet silencer comprising:

i. a rectangular inlet silencer housing having an entry end with a downward facing entry end opening, an exit end with a side facing exit end opening, and an inlet silencer length between the entry end and the exit end of the inlet silencer housing; and ii. sound insulation baffles extending along the length of the inlet silencer housing, wherein the exit end opening of the inlet silencer is closely coupled to the inlet end opening of the heating and cooling section; and c. an outlet silencer comprising:

i. a rectangular outlet silencer housing having an entry end with a side facing entry end opening, an exit end with a downward facing exit end opening, and an outlet silencer length between the entry end and the exit end of the outlet silencer housing; and ii. sound insulation baffles extending along the length of the outlet silencer housing, wherein the entry end opening of the outlet silencer is closely coupled to the outlet end opening of the heating and cooling section and wherein the baffles of the inlet silencer comprise an upper angled baffle positioned opposite the entry end opening and a lower block baffle with a rounded edge adjacent the entry end opening, and wherein the upper angled baffle and the lower block baffle are filled with sound insulation material.

2. The fan coil ceiling unit of claim 1, wherein the length of the inlet silencer is a maximum of 24 inches and the length of the outlet silencer is a maximum of 24 inches.

3. A fan coil ceiling unit for drawing air from an occupied space, conditioning the air, and discharging the conditioned air back into the occupied space, the fan coil ceiling unit comprising:

a. a heating and cooling section having a inlet end with an inlet end opening and a outlet end with an outlet end opening;

b. an inlet silencer comprising:

i. a rectangular inlet silencer housing having an entry end with a downward facing entry end opening, an exit end with a side facing exit end opening, and an inlet silencer length between the entry end and the exit end of the inlet silencer housing; and ii. sound insulation baffles extending along the length of the inlet silencer housing, wherein the exit end opening of the inlet silencer is closely coupled to the inlet end opening of the heating and cooling section; and c. an outlet silencer comprising:

i. a rectangular outlet silencer housing having an entry end with a side facing entry end opening, an exit end with a downward facing exit end opening, and an outlet silencer length between the entry end and the exit end of the outlet silencer housing; and ii. sound insulation baffles extending along the length of the outlet silencer housing, wherein the entry end opening of the outlet silencer is closely coupled to the outlet end opening of the heating and cooling section and wherein the baffles of the outlet silencer comprise a rounded upper baffle, a rounded lower baffle, and opposite side baffles, and wherein the rounded upper baffle, a rounded lower baffle, and the opposite side baffles are filled with sound insulation material.

4. The fan coil ceiling unit of claim 3, wherein the entry end opening of the outlet silencer is smaller in cross-sectional area than the exit end opening of the outlet silencer.

* * * * *